United States Patent [19]

Hasircoglu

[11] Patent Number: 4,640,565

[45] Date of Patent: Feb. 3, 1987

[54] EJECTING LATCH FOR ELECTRICAL CONNECTORS

[75] Inventor: Alexander W. Hasircoglu, Lancaster, Pa.

[73] Assignee: E. I. Du Pont de Nemours and Company, Wilmington, Del.

[21] Appl. No.: 739,032

[22] Filed: May 29, 1985

[51] Int. Cl.[4] ..... H01R 13/62

[52] U.S. Cl. ..... 339/45 M; 339/176 M

[58] Field of Search ..... 339/45, 46, 91 R, 75 R, 339/75 M

[56] References Cited

U.S. PATENT DOCUMENTS

| | | | |
|---|---|---|---|
| 2,051,425 | 8/1936 | Schlums | 173/361 |
| 3,836,938 | 9/1974 | Barrett, Jr. et al. | 339/45 R |
| 3,993,390 | 11/1976 | Eigenbrode | 339/91 R |
| 4,070,081 | 1/1978 | Takahashi | 339/91 R |
| 4,105,275 | 8/1978 | Dixon et al. | 339/91 |
| 4,241,966 | 12/1980 | Gomez | 339/45 M |
| 4,341,428 | 7/1982 | Hatch et al. | 339/14 R |
| 4,469,388 | 9/1984 | Narozny | 339/45 M |

FOREIGN PATENT DOCUMENTS

| | | | |
|---|---|---|---|
| 2082401 | 3/1982 | United Kingdom | 339/45 M |

OTHER PUBLICATIONS

"Berg Quickie TM IDC Ribbon Connector System", Du Pont Company/Berg Electronics, 1200 Bulletin, Nov. 1984.

*Primary Examiner*—Gil Weidenfeld
*Assistant Examiner*—David L. Pirlot

[57] ABSTRACT

An ejecting latch for selecting holding an electrical connector member to a header member or ejecting the connector member from the header member. The latch is operable even if several connectors are mounted very close together.

8 Claims, 4 Drawing Figures

EJECTING LATCH FOR ELECTRICAL CONNECTORS

BACKGROUND OF THE INVENTION

This invention relates to electrical connectors and more particularly to latches for both holding together and separating the two parts of an electrical connector.

Electrical connectors for making large numbers of interconnections are used extensively in computers and other similar electronic apparatus. For example, although there is considerable variation in the known connector sizes, connectors for making 26 or more connections are very common. Each individual connection may be made by inserting a pin (male terminal) in a socket (female terminal), or by joining two identical "hermaphroditic" terminals. The connectors typically include two components: a header member and a connector member which is removably plugged into the header member along a connector axis. In a typical installation, the header member may be mounted on a printed circuit board or other similar element, and the connector member may be attached to the end of a multiple conductor cable. Many other aplications are known to those skilled in the art.

Although the connector may provide a large number of connections, the spacing between the individual connections is typically relatively small (e.g., approximately 0.1 inches). Thus the overall dimensions of the connector member and the header member are also relatively small. For example, the mating faces of the connector member and the header member may measure approximately 0.25 inches by 1.5 inches in a connector for making 26 connections in two parallel rows on 0.1 inch centers.

Considerable force may be required to plug the connector member into the header member in the above-described connectors because of the large number of electrical connections being made simultaneously. For the same reason, considerable force may be required to unplug the connector member from the header member. It is known to provide latches on the header member for releasably engaging a connector member to additionally secure the connector member to the header member. The known latches also cooperate with ejection surfaces on the connector member for separating the connector member from the header member when the latches are deliberately released. This greatly facilitates unplugging the connector member from the header member and eliminates the need for possibly destructive pulling on the relatively small connector elements or the components (e.g., cables or printed circuit boards) to which the connector elements are attached.

The known ejecting latches described above are confined to the area near the interface between the connector member and the header member. This interface may be relatively inaccessible, particularly in applications in which there are several closely spaced connectors.

It is therefore an object of this invention to improve ejecting latches for electrical connectors of the type described above.

It is another object of this invention to provide ejecting latches for electrical connectors which can be easily operated even where there are several closely spaced connectors.

SUMMARY OF THE INVENTION

These and other objects of the invention are accomplished in accordance with the principles of the invention by providing ejecting latches pivotally mounted on the header member of a connector adjacent the interface between the header member and a connector member plugged into the header member, the latches having arms which extend rearwardly past the rear of the connector member so that the arms can be easily manipulated to operate the latches even when several connectors are mounted very close to one another.

Further features of the invention, its nature and various advantages will be more apparent from the accompanying drawings and the following detailed description of the invention.

BRIEF DESCRIPTION OF THE DRAWINGS

FIG. 1 is taken along the line 1—1 in FIG. 2.

DETAILED DESCRIPTION OF THE INVENTION

Figure 2:
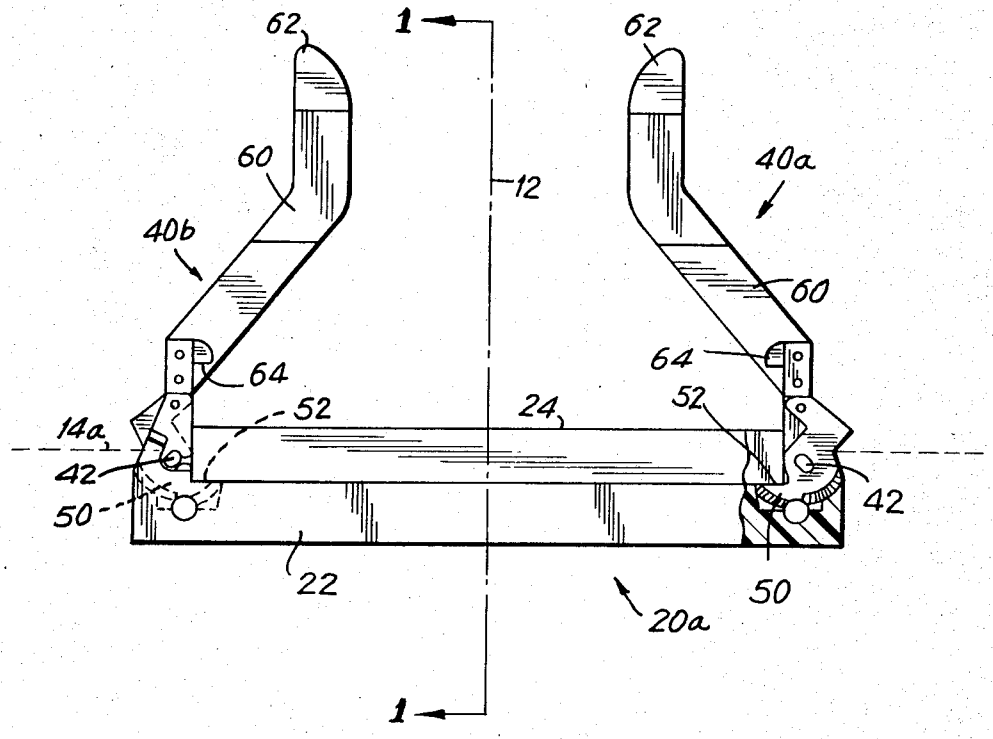
FIG. 2 is a view taken along the line 2—2 in FIG. 1.
Figure 1:
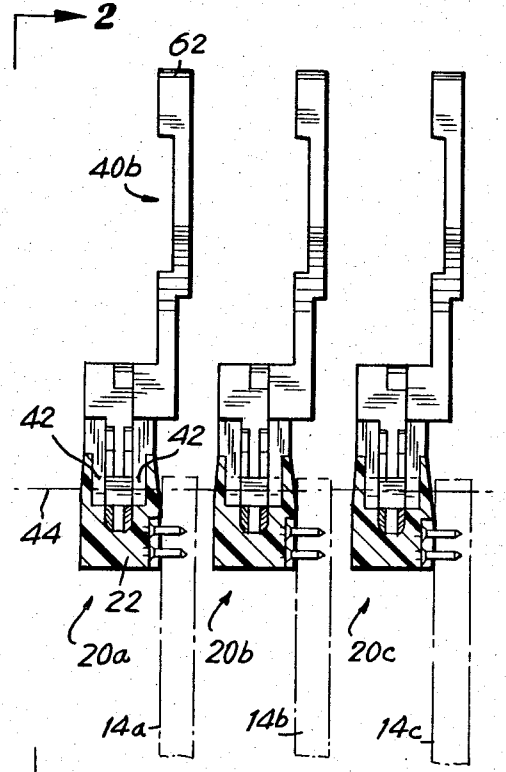
FIG. 1 is a cross sectional view of several header members constructed in accordance with the principles of this invention.

Illustrative connector header members 20*a*–*c*and x constructed in accordance with the priciples of this invention are shown in FIG. 1–4. All of the header members shown in the drawings are identical to one another, and all or any one are therefore referred to generically by reference number 20 with no letter suffix. Each header member 20 includes a main body 22 having a substantially rectangular connector interface 24 which is adapted to mate with the connector interface 84 of compatible connector member 80 when the connector member is plugged into the header member by relative motion of the header and connector members parallel to connector axis 12. Although many other equivalent header configurations are known to those skilled in the art, illustrative header member 20 is adapted to be plugged into a printed circuit board 14 near the edge of the board so that connector interface 24 is substantially perpendicular to the plane of the board.

Ejecting latches 40*a* and 40*b* are pivotally mounted on or in main body 22 adjacent the respective opposite ends of connector interface 24. Ejecting latches 40*a* and 40*b* are mirror images of one another about an intermediate mirror plane. The pivotal mounting of each ejector latch 40 comprises oppositely extending lugs 42 which project into mating recesses in main body 22. Accordingly, the pivotal axis of each ejecting latch 40 passes through the lugs 42 of that ejecting latch parallel to or coincident with axis 44.

Each ejecting latch 40 includes first (50) and second (60) lever arms, each of which extends approximately perpendicularly from the pivotal axis of that latch. The first lever arm 50 of each ejecting latch extends from the associated pivotal axis generally toward the rear of header member 20 (i.e., behind connector interface 24.). The second lever arm 60 of each ejecting latch extends from the associated pivotal axis in a direction generally away from the associated first lever arm 50.

Figure 4:
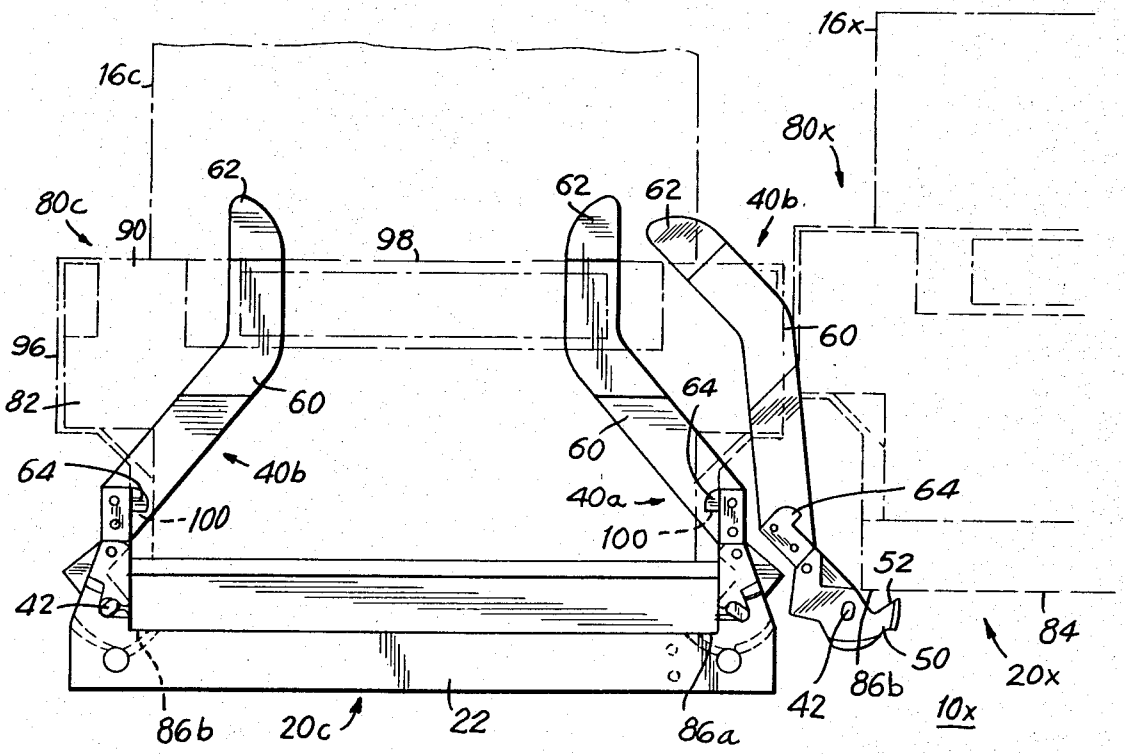
FIGS. 3 and 4 are views respectively similar to FIGS. 1 and 2 showing a connector member plugged into a header member constructed in accordance with the principles of the invention.
Figure 3:
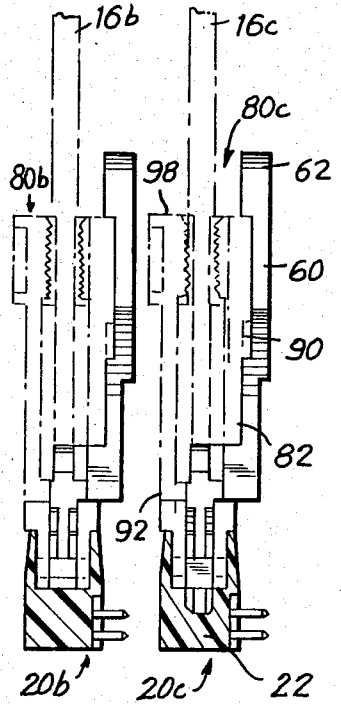

As mentioned above, each header member 20 is adapted to receive a connector member 80 so that the header member connector interface 24 and the connector member connector interface 84 mate as shown in FIGS. 3–4. Connector member 80 includes a main body 82 having first and second substantially planar, substantially parallel side surfaces 90 an 92 extending rearwardly from respective first and second substantially parallel sides of connector interface 84. Third and fourth side surfaces 94 and 96 extend rearwardly from respective third and fourth substantially parallel sides of connector face 84. Side surfaces 94 and 96 are substantially perpendicular to side surfaces 90 and 92. Although other equivalent connector configurations are known to those skilled in the art, illustrative connector member 80 is adapted to be connected to the end of multiple conductor cable 16. The end of cable 16 enters connector member 80 via the rear 98 of the connector member.

Main body 82 includes ejection surfaces **86*a* and 86*b* adjacent to and facing in substantially the same direction as connector interface 84. When connector member 80 is plugged into header member 20, each of ejection sirfaces 86*a* and 86*b* is in face-to-face proximity to an ejection surface 52 on each of ejecting latches 40*a* and 40*b*. Each ejection surface 52 is near the end of the associated first lever arm 50 remote from the pivotal axis of the associated ejecting latch. Ejection surfaces 52 face in generally the same direction as connector interface 24, although the direction in which surfaces 52** face changes as the associated ejecting latch is pivoted.

When connector member 80 is plugged into header member 20, the second lever arms 60 of associated ejecting latches 40 traverse side surface 90 of the connector member. The end portion 62 of each second lever arm 60 remote from the associated ejection latch pivotal axis projects beyond the rear end 98 of connector member 80. In the depicted preferred embodiment, the second lever arms 60 of ejecting latches **40*a* and 40*b* are synclinal in the direction toward the rear 98 of connector 80** when the connector is plugged into its header.

When it is desired to disconnect connector member 80 from header member 20, end portions 62 of ejecting latches **40*a* and 40*b* are pushed apart as shown in relation to connector 10*x* in FIG. 4. This causes ejecting latches 40*a* and 40*b* to pivot clockwise and counterclockwise, repectively, as viewed in FIG. 4. This in turn causes ejection surfaces 52 to push ejection surfaces 86 in the direction toward the rear of connector member 80, thereby pushing the connector member away from header member 20 parallel to connector axis 12. The distance ot travel of ejection surfaces 86 parallel to connector axis 12 before either of ejecting latches 40 hits the ejecting latch 40 of an adjacent connector (such as connector 10*c* adjacent to connector 10*x*) is preferably at least approximately equal to the distance required to substantially break the electrical connections between connector member 80 and header member 20. Accordingly, after ejecting latches 40 have been pivoted as described above, the major portion of the resistance to unplugging connector member 80 from header member 20 has been overcome, and the connector member can be pulled away without risk of damage to any portion of the connector. The construction of ejecting latches 40, and especially the projection of end portions 62 rearwardly beyond the rear of connector member 80, makes it possible to manipulate the ejecting latches even when the connectors are arranged in very dense configurations as shown, for example, in FIGS. 1, 3, and 4**.

If desired, in addition to the above-described connector member ejecting function, ejecting latches 40 can also be used to releasably latch connector member 80 to header members 20. In the depicted preferred embodiment, this is accomplished by means of a lug 64 on the second lever arm 60 of each ejecting latch 40. Each lug 64 projects into a recess 100 in the adjacent third or fourth side surfaces 94 or 96 of connector member 80 when the connector member is plugged into header member 20 and the second lever arms 60 of the ejecting latches are pivoted toward one another. Lugs 64 and recesses 100 cooperate with one another to help secure connector member 80 to header member 20. When ejecting latches 40 are pivoted apart in order to eject connector member 80 from header member 20, lugs 64 withdraw from recesses 100 so as not to inhibit ejection of the connector member.

I claim:

1. Electrical connector apparatus comprising:

a connector member having (1) a substantially rectangular first connector face, (2) first and second substantially planar, substantially parallel side surfaces perpendicualr to the first connector face, each of the first and second side surfaces extending rearwardly from respective first and second substantially parallel sides of the first connector face, and (3) at least one ejection surface substantially parallel and adjacent to the first connector face and facing in substantially the same direction as the first connector face;

a header member having a second rectangular connector face for removably receiving the connector member along a connector axis which is mutually perpendicular to the first and second connector faces for making a plurality of electrical connections between the header member and the received connector member; and an ejecting latch pivotally mounted on the header member adjacent the second connector face, the pivotal axis of the latch being substantially perpendicular to the first and second side surfaces of the received connector member, the latch having (1) a first lever arm extending substantially perpendicularly from the pivotal axis, said first lever arm having an ejection element bearing on the ejection surface of the received connector member, and (2) a second lever arm offset and projecting from the first lever arm, said second arm extending adjacent and angularly across one of said side surfaces of the received connector member in a direction toward the rear of said connector member, said second lever arm terminating with an end portion which is located beyond the rear of the received connector member so that the latch can be pivoted by engaging the end portion, thereby causing the first lever arm to push the ejection surface and the received connector member away from the header member said second lever arm is its ejecting position extending substantially perpendicular to said first connector face, whereby obstruction from an adjacent connector is avoided.

2. The apparatus defined in claim 1 wherein the connector member and the latch include cooperating latching surfaces for preventing the received connector member from moving away from the header member except when the latch is pivoted to push the received connector member away from the header member.

3. The apparatus defined in claim 2 wherein the cooperating latching surfaces comprise:

a first latching surface on the connector member facing away from the first connector face; and a second latching surface on the second lever in face-to-face contact with the first latching surface on the received connector except when the latch is pivoted to push the received connector member away from the header member.

4. The apparatus defined in claim 1 wherein the latch is a first latch pivotally mounted adjacent an end surface of the received connector member, and wherein the apparatus further comprises a second similar latch pivotally mounted adjacent the other end surface of the received connector member for cooperating with a second ejection surface on the connector member in the same manner that the first latch cooperates with the associated ejection surface.

5. The apparatus defined in claim 4 wherein the second lever arms of the first and second latches are synclinal toward the rear of the received connector member.

6. The apparatus defined in claim 5 wherein the second lever arms of the first and second latches are pivoted away from one another to push the received connector member from the header member.

7. The apparatus defined in claim 6 wherein the second lever arms of the first and second latches are substantially parallel to one another when the received connector member has been pushed from the header member.

8. In an interconnection including a connector, a header adapted to receive the connector and a latch on the header for ejecting the received connector, the improvement comprising provision of first and second arms on said latch, said first arm being pivoted to the header, said second arm being offset laterally from the first arm and extending adjacent an angularly across a lateral surface of the received connector and beyond the rear of the received connector said second arm in its ejecting position extending substantially parallel to a side surface of the received connector whereby obstruction from an adjacent connector is avoided.

9. The interconnection of claim 8 wherein a second latch is provided, there being a latch at each end of the header.

* * * * *